US010059356B2

(12) United States Patent
Tougas

(10) Patent No.: US 10,059,356 B2
(45) Date of Patent: Aug. 28, 2018

(54) PROFILE MONITORING SYSTEM

(71) Applicant: Progress Rail Locomotive Inc., LaGrange, IL (US)

(72) Inventor: Thomas A. Tougas, Lee's Summit, MO (US)

(73) Assignee: Progress Rail Locomotive Inc., LaGrange, IL (US)

( * ) Notice: Subject to any disclaimer, the term of this patent is extended or adjusted under 35 U.S.C. 154(b) by 641 days.

(21) Appl. No.: 14/645,561

(22) Filed: Mar. 12, 2015

(65) Prior Publication Data

US 2016/0264160 A1 Sep. 15, 2016

(51) Int. Cl.
*B61L 27/00* (2006.01)

(52) U.S. Cl.
CPC ..... *B61L 27/0094* (2013.01); *B61L 27/0077* (2013.01)

(58) Field of Classification Search
CPC .... B61L 27/0094; B61L 27/0077; B61L 1/00; B61L 5/206
See application file for complete search history.

(56) References Cited

U.S. PATENT DOCUMENTS 1,454,753 A * 5/1923 McGhee ..... B61L 29/24 116/28 R
1,587,307 A * 6/1926 Hastings ..... B61L 5/206 246/486
2,366,152 A * 12/1944 Lauterbach ..... B61L 1/20 246/486
2,531,565 A * 11/1950 Gottholm ..... B61L 1/20 24/601.3
3,009,026 A * 11/1961 Bonanno ..... A63H 19/24 191/29 R
2016/0264160 A1* 9/2016 Tougas ..... B61L 27/0077

FOREIGN PATENT DOCUMENTS

GB 240520 9/1925
GB 2052205 1/1981

* cited by examiner

*Primary Examiner* — Jason C Smith

(57) ABSTRACT

A profile monitoring system for a railroad car is provided. The profile monitoring system includes a fixture element configured to be coupled to a frame member at a predetermined location. The profile monitoring system also includes a tensioning device associated with the fixture element. The tensioning device is configured to be coupled to one end of a wire or cable, wherein the tensioning device is configured to maintain a predetermined tension in the wire or cable. The profile monitoring system further includes a sensing device coupled to the tensioning device, the sensing device is configured to sense a change in a tension in the wire or cable. The profile monitoring system includes a triggering module communicably coupled to the sensing device, the triggering module is configured to trigger an alarm based on the change in the tension in the wire or cable.

11 Claims, 7 Drawing Sheets

PROFILE MONITORING SYSTEM

TECHNICAL FIELD

The present disclosure relates to a profile monitoring system, and more particularly to a profile monitoring system for detecting a profile of railroad cars.

BACKGROUND

Height and width detectors are associated with railroad cars, in order to detect whether the railroad cars follow a prefixed profile. This way the railroad car that is out of the prefixed profile may be stopped before it causes damage to any infrastructure like a tunnel or bridge. Known height and width detectors include two types of detection methods, or a combination thereof. One method is to attach a wire between two poles at specific height and dimensions. The wires are connected to a battery and relay, to form a circuit. When the wire breaks, the circuit is broken, and an alarm is generated which indicates a possible deviation of the railroad car from the prefixed profile. Such height and width detectors rely on a battery and current to indicate if the wire is broken. In some situations, a broken wire may land on a track on which the railroad car operates or on other conductive sources, and create a closed circuit, thus indicating that the wire is not broken when indeed it is, which may create potential safety concerns.

Another detection method used by current height and width detectors include the use of Infrared (IR) beams. If a part of the railroad car breaks the IR beam, an alarm is generated which is indicative of a possible deviation of the railroad car from the prefixed profile. The detection methods using the IR beam are susceptible to false alarms. For example, if the railroad car has a loose canopy that is flapping in the wind and breaks the IR beam, this can create a false alarm.

U.S. Pat. No. 2,366,152 describes a system to detect high and wide cars or open top ladings which exceed the permissible clearances through tunnels, under bridges, etc.

SUMMARY OF THE DISCLOSURE

In one aspect of the present disclosure, a profile monitoring system for a railroad car is provided. The profile monitoring system includes a fixture element configured to be coupled to a frame member at a predetermined location. The profile monitoring system also includes a tensioning device associated with the fixture element. The tensioning device is configured to be coupled to one end of a wire or cable, wherein the tensioning device is configured to maintain a predetermined tension in the wire or cable. The profile monitoring system further includes a sensing device coupled to the tensioning device; the sensing device is configured to sense a change in a tension in the wire or cable. The profile monitoring system includes a triggering module communicably coupled to the sensing device; the triggering module is configured to trigger an alarm based on the change in the tension in the wire or cable.

In another aspect of the present disclosure, a profile monitoring system for a railroad car is provided. The profile monitoring system includes a frame assembly having a first frame member and a second frame member, wherein a space is defined between the first and second frame members to allow the railroad car to pass through. The profile monitoring system also includes a first fixture element and a second fixture element coupled to the first and second frame members respectively, wherein each of the first and second fixture elements are positioned at a predetermined location. The profile monitoring system further includes a wire or cable connected between the first and second fixture elements. The profile monitoring system includes a tensioning device associated with at least one of the first or second fixture elements. The tensioning device is configured to be coupled to one end of the wire or cable, wherein the tensioning device is configured to maintain a predetermined tension in the wire or cable. The profile monitoring system further includes a sensing device coupled to the tensioning device; the sensing device is configured to sense a change in a tension in the wire or cable. The profile monitoring system includes a triggering module communicably coupled to the sensing device; the triggering module is configured to trigger an alarm based on the change in the tension in the wire or cable.

In yet another aspect of the present disclosure, a method for monitoring a profile of a railroad car is provided. The method includes connecting one end of a wire or cable to a tensioning device associated with a fixture element. The method also includes connecting the tensioning device to a sensing device. The method further includes applying, a predetermined tension in the wire or cable by the tensioning device. The method includes sensing a change in a tension in the wire or cable by a sensing device. The method also includes triggering an alarm based on the change in the tension.

Other features and aspects of this disclosure will be apparent from the following description and the accompanying drawings.

DETAILED DESCRIPTION

Figure 1:
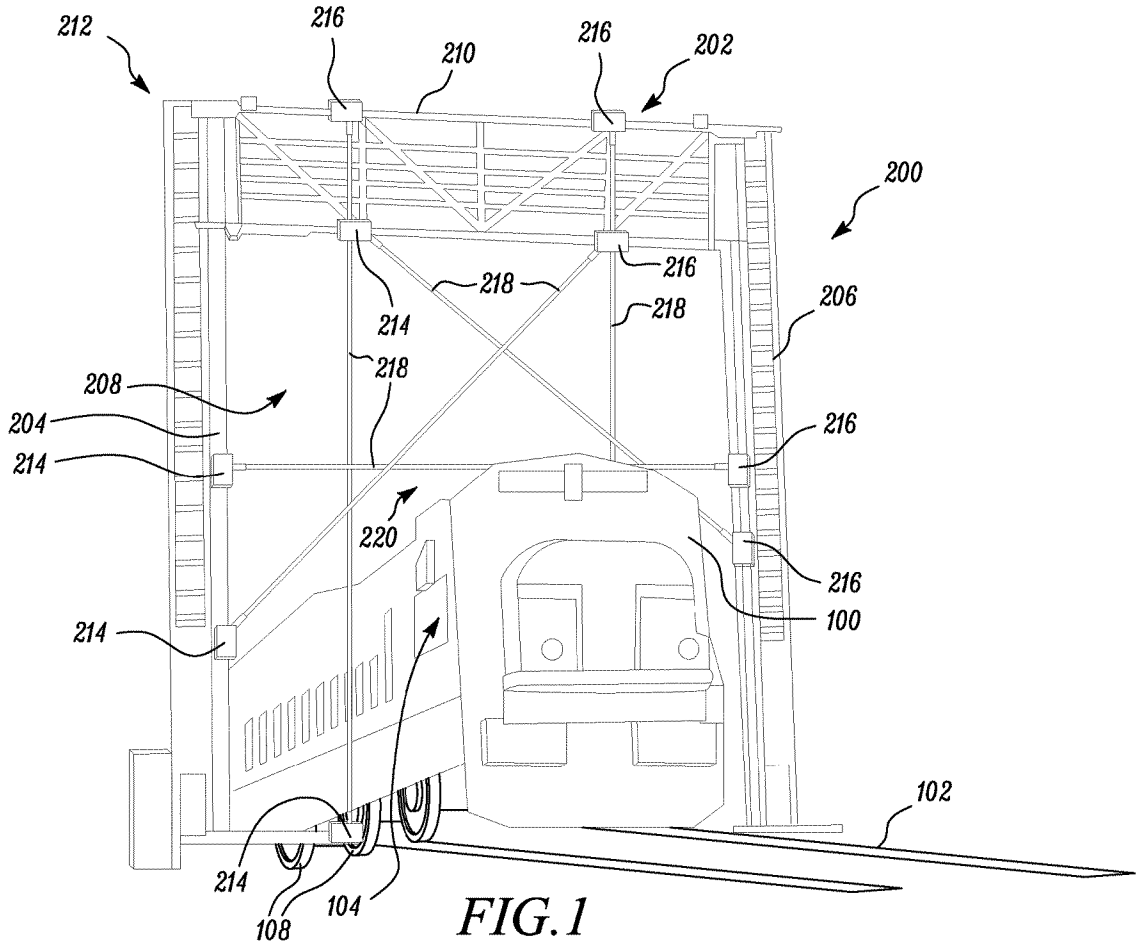
FIG. 1 is a perspective view of an exemplary railroad car and a profile monitoring system associated therewith, according to one embodiment of the present disclosure.

Wherever possible, the same reference numbers will be used throughout the drawings to refer to the same or the like parts. FIG. 1 is a perspective view of an exemplary railroad car 100, according to one embodiment of the present disclosure. The term "railroad car" referred to herein may include a group of two or more locomotive units or railroad cars that are mechanically coupled and/or linked with each other to travel on rails 102 along a route. The railroad car 100 may be used for transportation of passengers and/or cargo. It should be noted that the application of the present disclosure is not restricted to the railroad car 100 disclosed herein, and may be extended to any type of vehicle known to a person of ordinary skill in the art that may or may not run on the rails.

The railroad car 100 may include an engine (not shown) associated therewith. The engine is configured to provide driving power to the railroad car 100, in order to propel the railroad car 100. In one embodiment, the engine may include, for example, a diesel engine, a gasoline engine, a gaseous fuel powered engine such as, a natural gas engine, a combination of known sources of power, or any other type of power source apparent to one of skill in the art. The railroad car 100 includes at least one operator cab 104 for an operator to be present in for operating the railroad car 100. The operator cab 104 may include an operator interface (not shown). The operator interface may be, for example, a gauge or a console to display speed, fuel conditions, or other information regarding the railroad car 100. The operator interface may be embodied as any other input and/or output device such as a touchscreen, a LCD panel, a screen, a radio, a monitor to provide notifications to the operator of operational parameters associated with the railroad car 100.

The operator interface may also include a propulsion control mechanism, which may be communicably coupled to a propulsion system of the railroad car 100. The operator may operate the propulsion control mechanism to maneuver the railroad car 100. The operator interface may further include a plurality of input devices in addition to those mentioned above for controlling the railroad car 100 and to perform various operations thereon, without limiting the scope of the present disclosure. The railroad car 100 may also include a braking arrangement (not shown) to halt a movement of the railroad car 100. The braking arrangement may include a foot activated brake pedal provided in the operator cab 104. Alternatively, the braking arrangement may include a hand operated lever provided on the operator interface. The railroad car 100 also includes a plurality of wheels 108 for propulsion of the railroad car 100 on the rails 102.

The railroad car 100 is configured to follow a prefixed profile. However, in some situations, the railroad car 100 may deviate or deflect from the prefixed profile. For example, if the railroad car 100 is loaded with a piece of equipment that exceeds a height of a tunnel, it could damage the tunnel, equipment, or the railroad car 100 should it enter the tunnel. Alternately, if the railcar 100 is loaded with equipment that that is too wide for a bridge, it could damage the bridge, equipment, or the railroad car 100 should it enter the bridge. Therefore, a profile monitoring system 200 is associated with the railroad car 100. The profile monitoring system 200 is configured to determine whether the railroad car 100 is following the prefixed profile. The profile monitoring system 200 will now be explained in detail with respect to FIGS. 1 to 6.

Referring to FIG. 1, the profile monitoring system 200 includes a frame assembly 202. The frame assembly 202 includes at least one frame member. The frame assembly 202 of the present disclosure includes a first frame member 204 and a second frame member 206. The first and second frame members 204, 206 are embodied as vertical frame members, and are spaced apart from each other in a longitudinal direction. As shown in the accompanying figures, the railroad car 100 is configured to pass through a space 208 defined between the first and second frame members 204, 206. A distance between the first and second frame members 204, 206 may be decided based on a width of the railroad car 100 and a width of the rails 102. The distance between the first and second frame members 204, 206 is greater compared to the width of the railroad car 100 and/or the width of the rails 102. In the illustrated embodiment, a pair of the rails 102 is depicted. However, based on system requirements, the distance between the first and second frame members 204, 206 may be varied in order to accommodate two or more rails therebetween.

The profile monitoring system 200 of the present disclosure also includes a third frame member 210. The third frame member 210 is configured to be attached near a top portion 212 of the first and second frame members 204, 206. More particularly, the third frame member 210 is provided horizontally, such that the first and second frame members 204, 206 are connected by the third frame member 210 at the top portion 212. A height at which the third frame member 210 is connected to each of the first and second frame members 204, 206 is decided based on a height of the railroad cars that may pass through the space 208. The first, second, and third frame members 204, 206, 210 disclosed herein may be embodied as masts or pipes having a sturdy structure.

The profile monitoring system 200 may include a plurality of fixture elements. The profile monitoring system 200 of the present disclosure includes five pairs of fixture elements, wherein each pair of fixture elements include a first fixture element 214 (see FIG. 3) and a second fixture element 216 (see FIG. 4). Further, a wire or cable 218 may be connected between the first fixture element 214 and the second fixture element 216. As shown in the accompanying figures, the wires or cables 218 are provided such that a space 220 formed by the plurality of connecting wires or cables 218 is configured to allow for the passage of the railroad car 100 through. It should be noted that the pair of fixture elements 214, 216 and corresponding number of wires or cables 218 shown in the accompanying figures are exemplary, and may vary based on system requirements. Further, the wire or cable 218 may include any wire, string, fiber, cable, and/or cord made from a metallic or non-metallic material. A thickness, length, and diameter of the wire or cable 218 may vary based on system requirements.

In one embodiment of the present disclosure, the first fixture element 214 and the second fixture element 216 are respectively coupled to the first and second frame members 204, 206. However, as per system requirements, any one of the first or second fixture element 214, 216 may be interchangeably mounted to the first, second, and/or third frame members 204, 206, 210, without limiting the scope of the present disclosure. It should be noted that each of the first and second fixture elements 214, 216 are positioned at a predetermined location. This location may include a fixed height from ground level, a predetermined distance from a center of the rails 102, or both. Further, the first and second fixture elements 214, 216 may be positioned at same or different heights and distances from the center of the rails 102, based on system requirements.

Figure 2:
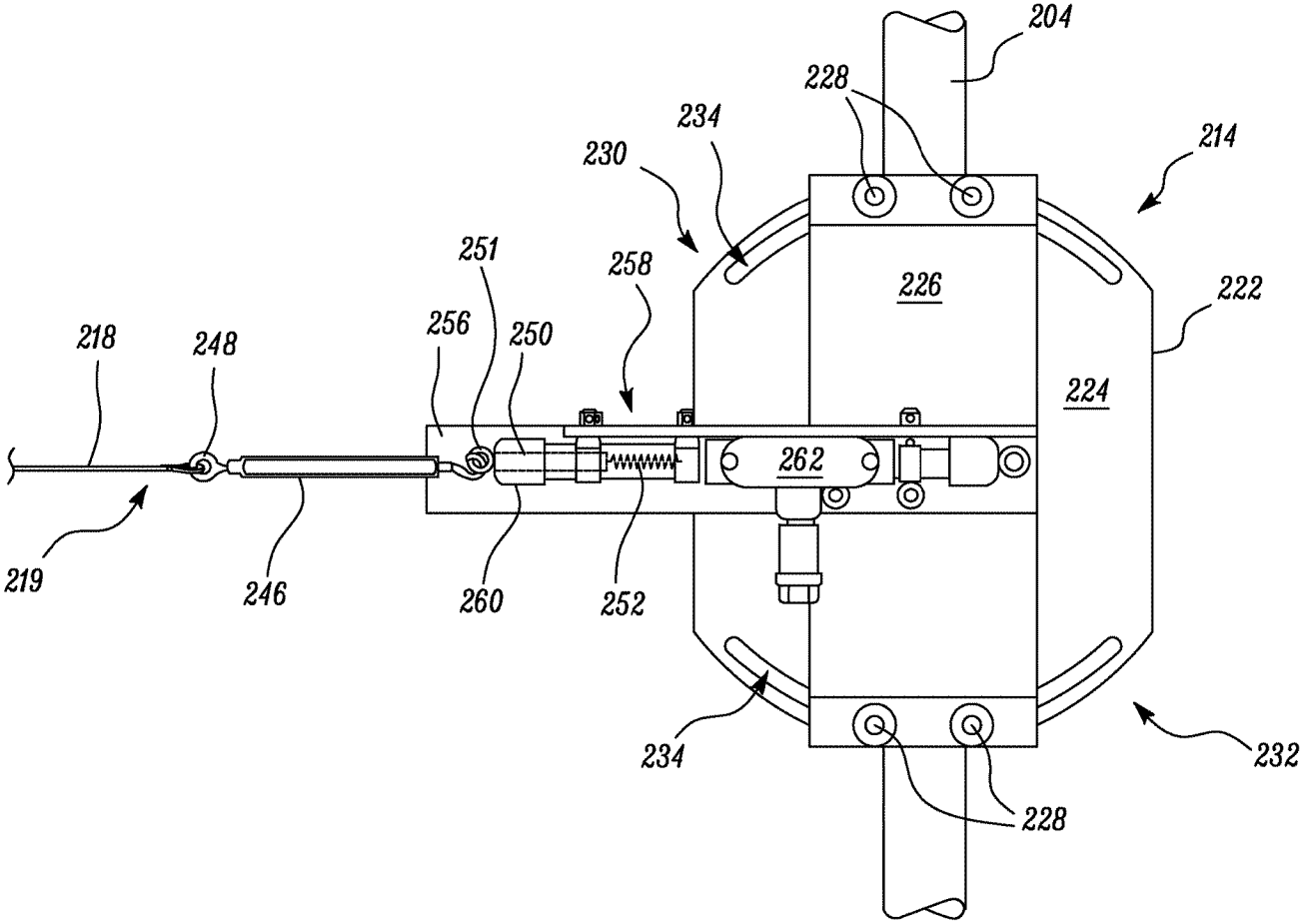
FIG. 2 is a front view of a first fixture element of the profile monitoring system associated with the railroad car, according to one embodiment of the present disclosure.

FIG. 2 is a front view of the first fixture element 214 coupled to the first frame member 204. The first fixture element 214 is configured to be connected to a first end 219 of the wire or cable 218. The first fixture element 214 includes a first bracket 222. The first bracket 222 includes a first plate 224. The first plate 224 of the first bracket 222 is fixedly connected to the first frame member 204 using suitable mechanical fastening means. In one embodiment, a pair of U-bolts (not shown) may be used to connect the first plate 224 to the first frame member 204. Alternatively, any other type of bolts, pins, screws, rivets, and the like may be used for fastening purposes. The first bracket 222 also includes a second plate 226.

Based on the prefixed profile of the railroad car 100, the wire or cable 218 connected between the first and second fixture elements 214, 216 may be connected at different angles on the frame assembly 202. For this purpose, the second plate 226 is able to swivel while connected to the first plate 224. More particularly, the second plate 226 is coupled to the first plate 224 through swivel connections 228 at a top portion 230 and a bottom portion 232, so that the second plate 226 may be swiveled in a clockwise or anti-clockwise direction with respect to the first plate 224. Further, in order to allow the second plate 226 to swivel, the first plate 224 includes slots 234 for allowing a movement of the swivel connections 228 therein. The swivel connections 228 may embody any of a bolt, screw, rivet, pin, and the like. The swivel connections 228 may be loosened so that the swivel connections 228 travel within the slots 234 for an adjustment of the second plate 226. The swivel connections 228 may be adjusted and tightened to a required angle or position.

Figure 3:
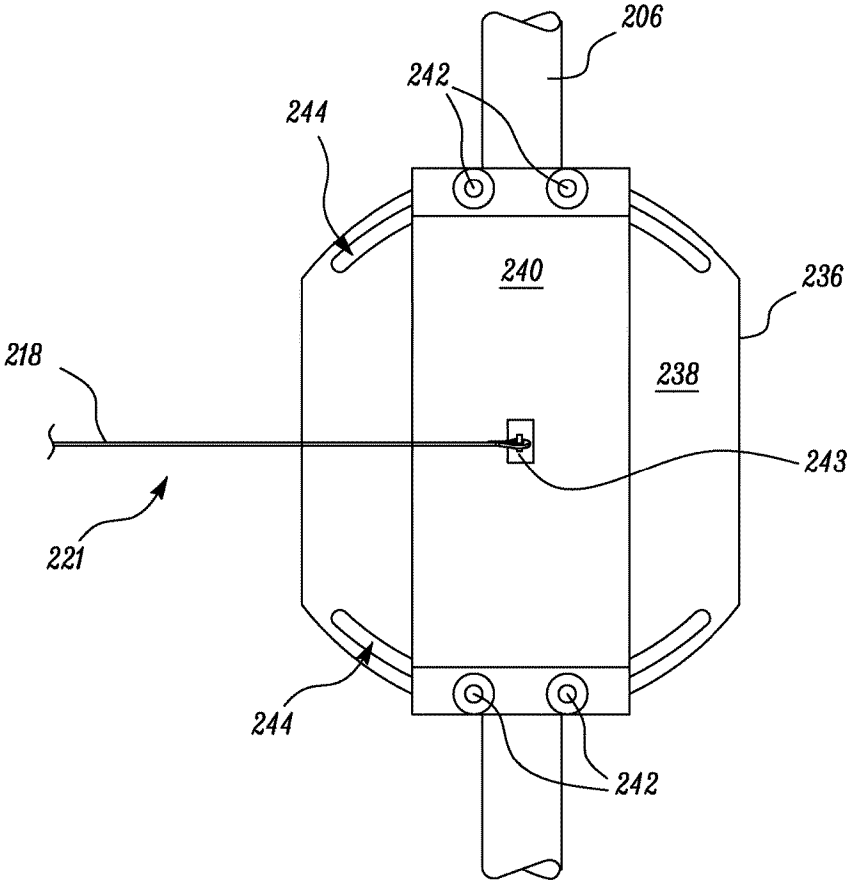
FIG. 3 is a front view of a second fixture element of the profile monitoring system associated with the railroad car, according to one embodiment of the present disclosure.

FIG. 3 illustrated a front view of the second fixture element 216 coupled to the second frame member 206. It should be noted that the second fixture element 216 may also include similar constructional features and design. Accordingly, the second fixture element 216 may include the second bracket 236 having the first and second plates 238, 240, wherein the second plate 240 is connected to the first plate 238 through the swivel connections 242. The second fixture element 216 may include an eyebolt 243. The eyebolt 243 is configured to receive and fixedly connect a second end 221 of the wire or cable 218 to the second fixture element 216, such that the wires or cables 218 do not move during an operation thereof. Further, the swivel connections 242 may be loosened so that the swivel connections 242 travel within the slots 244 for an adjustment of the second plate 240. Based on system requirements, the swivel connections 242 may be adjusted and tightened to the required angle or position.

Figure 4:
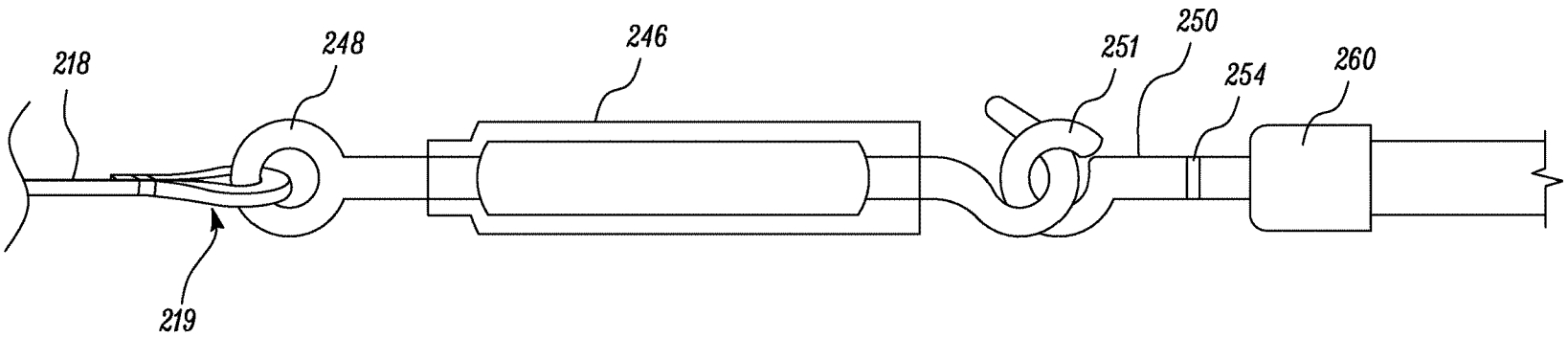
FIGS. 4 and 5 are front views of a portion of the first fixture element, according to one embodiment of the present disclosure.
Figure 5:
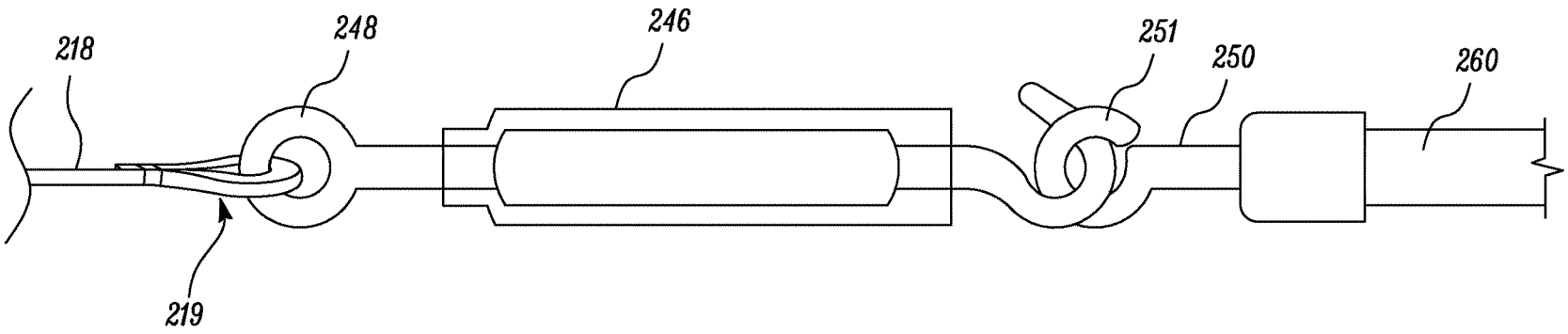

Referring to FIGS. 2, 4, and 5, the first end 219 of the wire or cable 218 is configured to be coupled to a tensioning device 246. In one example, the tensioning device 246 includes an eyebolt 248 provided at one end in order to receive the wire or cable 218. The tensioning device 246 is configured to maintain a predetermined tension in the wire or cable 218. In one example, the tensioning device 246 may include a turnbuckle. Alternatively, the tensioning device 246 may include any device capable of maintaining the predetermined tension in the wire or cable 218. Further, a second end of the tensioning device 246 is connected to a shaft 250. The shaft 250 may embody any one of a solid or hollow rod having square, circular, or rectangular cross-section. In one example, the shaft 250 may include eyebolts 251 provided at either ends for an attachment of the tensioning device 246 at one end and a spring element 252 (see FIG. 2) at another end. The shaft 250 may include a mark 254 (see FIG. 4) provided on an outer surface thereof. The shaft 250 may be partially enclosed within an enclosure 260.

As shown in the accompanying figures, the first fixture element 214 includes a shroud 256 (see FIG. 2). The shroud 256 is coupled to the second plate 226 of the first bracket 222 using suitable mechanical fastening means, such as bolts. The shroud 256 is configured to protect a sensing device 258 of the profile monitoring system 200 from contact of ice and/or debris. The sensing device 258 disclosed herein is configured to sense a change in the tension in the wire or cable 218.

The sensing device 258 includes the spring element 252. The spring element 252 may embody any device capable of expanding and/or retracting based on an application or release of force. The spring element 252 is enclosed within the enclosure 260. Further, the tensioning device 246 is coupled to the spring element 252 of the sensing device 258, via the shaft 250. Further, the spring element 252 is configured to be tensioned, via the tensioning device 246 and the shaft 250, based on the tension in the wire or cable 218. As shown in FIG. 4, when the tensioning device 246 is tensioned, the spring element 252 is held in a retracted position therein, and the mark 254 on the shaft 250 is visible. As shown in FIG. 5, in a released or expanded position of the spring element 252, the mark 254 on the shaft 250 is enclosed within the enclosure 260, and is thus hidden from view.

Figure 6:
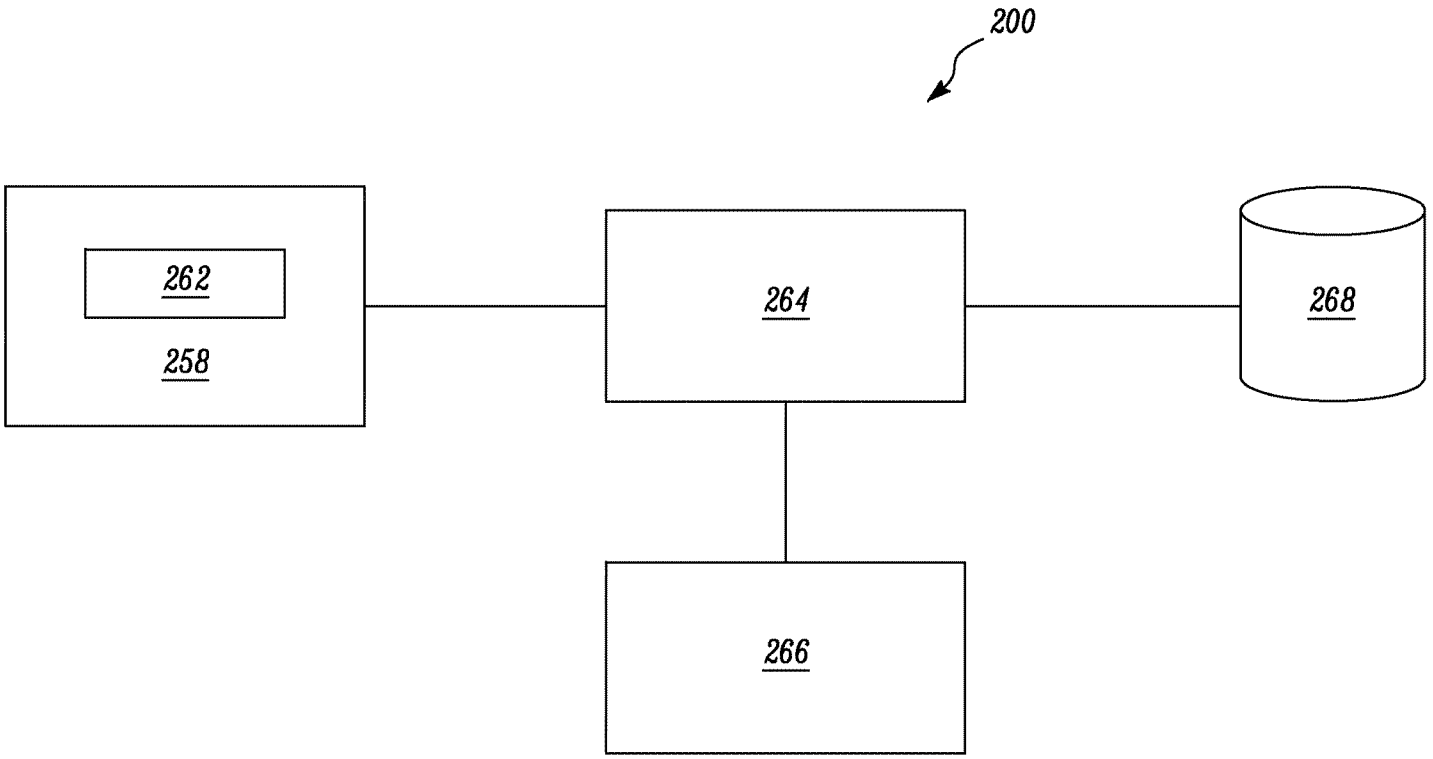
FIG. 6 is a block diagram of the profile monitoring system, according to one embodiment of the present disclosure.

Referring to FIGS. 2 and 6, the sensing device 258 includes a sensor element 262. The sensor element 262 is positioned near a second end of the spring element 252. In one embodiment, the sensor element 262 may include a proximity sensor. Alternatively, the sensor element 262 may include any known device capable of sensing or detecting presence of objects nearby with or without physical contact.

Further, the profile monitoring system 200 includes a triggering module 264 (see FIG. 6). The triggering module 264 is communicably coupled to the sensing device 258. The triggering module 264 is configured to receive signals from the sensor element 262 of the sensing device 258, and receive signals therefrom. The triggering module 264 is configured to trigger an alarm based on the change in the tension in the wire or cable 218. It should be noted that the communication between the sensing device 258 and the triggering module 264 may be wired or wireless, based on the type of application.

Referring to FIG. 4, when the wire or cable 218 is attached to the tensioning device 246, the tensioning device 246 is tightened to put tension on the wire or cable 218 until the shaft 250 extends out of the enclosure 260 and uncovers the mark 254 on the shaft 250. In one example, a tension of approximately 30 lbs. may be provided to the wire or cable 218. It should be noted that after initial tensioning, the wire or cable 218 may stretch slightly. Hence, after a time window the tension in the wire or cable 218 may have to be checked again, and required tightening of the tensioning device 246 may be performed. Further, after an initial installation of the wire or cable 218, periodic maintenance checks may be performed to confirm whether or not the wire or cable 218 is still taut.

In a situation wherein the railroad car 100 does not follow the prefixed profile, a portion of the railroad car 100 may contact the wire or cable 218 and change the tension in the wire or cable 218. In some examples, the wire or cable 218 may break based on an impact of the portion of the railroad car 100 therewith. In some embodiments, the wire or cable 218 may break at approximately 60 lbs., when the initial tension provided to the wire or cable 218 is approximately 30 lbs.

Based on the impact of the railroad car 100 with the wire or cable 218, a state of the spring element 252 coupled to the wire or cable 218, via the shaft 250 and the tensioning device 246, may change. More particularly, based on the impact, the tension in the wire or cable 218 is released, which in turn leads to a release in the spring tension of the spring element 252 of the sensing device 258 leading to an expansion thereof. The change in the state of the spring element 252 is detected by the sensor element 262. Further, the sensor element 262 communicates this change in the state of the spring element 252 to the triggering module 264. Further, based on the change in the tension in the wire or cable 218, the triggering module 264 triggers an alert notification in order to inform a person, such as the operator or personnel present at the remote location, of a discrepancy in the profile of the railroad car 100. The triggering module 264 triggers an alert notification in order to inform the person of the release in the tension of the wire or cable 218, and thereby indicate the person that the railroad car 100 is not following the prefixed profile.

During operation, the wire or cable 218 attached between the first and second fixture elements 214, 216 may move causing a slight change in the tension in the wire or cable 218. This movement may be due to factors, such as wind or when a canopy of the railroad car 100 impacts the wire or cable 218. Such situations may not be indicative of the deviation of the railroad car 100 from the prefixed profile. Hence, the profile monitoring system 200 of the present disclosure is designed to accommodate slight changes in the tension of the wire or cable 218 without triggering the alert notification.

In some examples, the sensor element 262 may be configured to determine parameters, such as a change in a state of the spring element 252 or change in force/pressure of the spring element 252 as a result of the change in the tension in the wire or cable 218. The sensor element 262 may send signals related to one of the parameters of the spring element 252 to the triggering module 264. Further, the triggering module 264 is configured to retrieve data related to the predetermined threshold corresponding to the respective parameters from a database 268. Further, the triggering module 264 may compare the signals received from the sensor element 262 with the respective predetermined threshold. If the signals received from the sensor element 262 do not match with the predetermined threshold retrieved from the database 268, the triggering module 264 may trigger the alert notification in order to inform the person of a possible deviation of the railroad car 100 from the prefixed profile or a possible deviation in tension due to other factors.

The location of the database 268 may vary based on the application. The predetermined thresholds stored within the database 268 may be retrieved from any external source(s) and/or updated on a real time basis. The database 268 may be any conventional or non-conventional database known in the art. Moreover, the database 268 may be capable of storing and/or modifying pre-stored data as per operational and design needs.

The alert notification may be provided via an output module 266 (see FIG. 6). The output module 266 is communicably coupled to the triggering module 264 in a wired or wireless manner. The output module 266 is configured to receive information of the identified change in the tension in the wire or cable 218 from the triggering module 264. The output module 266 is also configured to provide an indication to the person, of a changed, stretched, or broken state of the wire or cable 218. The output module 266 may be mounted at a location such that the output module 266 may be viewable to the person. In one embodiment, the output module 266 may be present in the railroad car 100. For example, the output module 266 may be present in the operator cab 104 of the railroad car 100, and may be viewable on the operator interface. The output module 266 may also be present at a location external to the railroad car 100, for example, at the remote location, such as, a base station.

The output module 266 may embody a visual output or an audio output. In one example, wherein the output module 266 is embodied as a visual output, the output module 266 may include any one of a digital display device, an LCD device, an LED device, a CRT monitor, a touchscreen device, or any other display device known in the art. In one example, the output module 266 may notify the person regarding the changed, stretched, or broken state of the wire or cable 218, through a text message or a voice message.

Alternatively, the output module 266 may include an indicator light. An LED light or an LCD light may be used to alert the person of the changed, stretched, and/or broken state of the wire or cable 218. For example, if the wire or cable 218 is taut, the indicator light may glow of a green color, indicating to the person that the railroad car 100 is following the prefixed profile. In another example, if the tension in one of the wires or cables 218 changes based on the impact with the railroad car 100, the indicator light may glow of a red color indicating to the person that the railroad car 100 is not following the prefixed profile. It should be noted that the output module 266 may include any other means other than those listed above.

The triggering module 264 may embody a set of relay(s), a single microprocessor or multiple microprocessors for receiving signals from components of the profile monitoring system 200. Numerous commercially available microprocessors may be configured to perform the functions of the triggering module 264. It should be appreciated that the triggering module 264 may embody a machine microprocessor capable of controlling numerous machine functions. A person of ordinary skill in the art will appreciate that the triggering module 264 may additionally include other components and may also perform other functions not described herein.

It should be noted that the first frame member, second frame member, third frame member, and the components of the first and second fixture elements may be made from any metal or non-metal known in the art.

INDUSTRIAL APPLICABILITY

The present disclosure describes the profile monitoring system 200 for monitoring whether the current profile of the railroad car 100 matches with the prefixed profile. More particularly, the triggering module 264 is configured to receive signals indicative of the changes and/or broken state of the wire or cable 218 from the sensor element 262, thereby indicating that the railroad car 100 does not match the prefixed profile. Further, the alert notification is provided to the person through the output module 266, based on the signals received from the triggering module 264.

The profile monitoring system 200 of the present disclosure may provide a more accurate monitoring of the profile of the railroad car 100 and may additionally avoid or reduce the number of instances that may cause false generation of the alarm. Further, the profile monitoring system 200 does not require a current flow through the wire or cable 218 at any time for detection of the profile of the railroad car 100.

Figure 7:
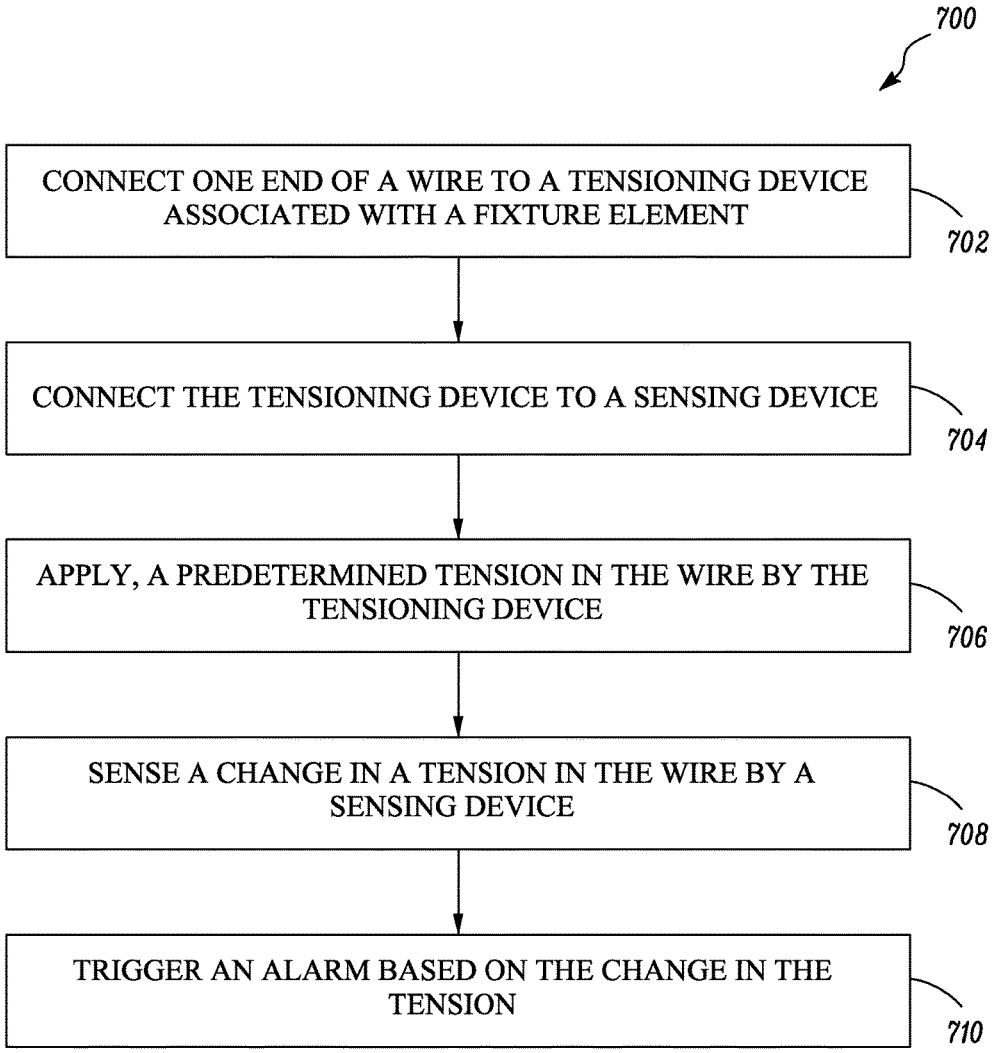
FIG. 7 is a flowchart for a method of monitoring a profile of the railroad car.

FIG. 7 is a flowchart for a method for monitoring the profile of the railroad car 100. At step 702, the first end 219 of the wire or cable 218 is connected to the tensioning device 246 associated with the first fixture element 214. At step 704, the tensioning device 246 is connected to the sensing device 258. At step 706, the predetermined tension is applied to the wire or cable 218 by the tensioning device 246. Further, the spring tension is applied to the spring element 252 connected to the wire or cable 218, based on the tension applied to the wire or cable 218. At step 708, the change in the tension in the wire or cable 218 is sensed by the sensing device 258. The change or breaking of the wire or cable 218 is sensed based on the change in the state of the spring element 252 connected to the wire or cable 218. Further, the change in the state of the spring element 252 is based on the change in the state of the wire or cable 218.

At step 710, the triggering module 264 is configured to trigger the alarm based on the change in the tension in the wire or cable 218. Further, based on the triggering of the alarm, it is identified that the current profile of the railroad car 100 does not match the prefixed profile. The alert notification is provided to the person through the output module 266, such as the operator or the personnel.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A profile monitoring system for a railroad car, the profile monitoring system comprising:

a fixture element configured to be coupled to a frame member at a predetermined location;

a tensioning device associated with the fixture element, the tensioning device configured to be coupled to one end of a wire or cable, wherein the tensioning device is configured to maintain a predetermined tension in the wire or cable, and wherein the tensioning device includes a turnbuckle;

a sensing device coupled to the tensioning device, the sensing device configured to sense a change in a tension in the wire or cable; and a triggering module communicably coupled to the sensing device, the triggering module configured to trigger an alarm based on the change in the tension in the wire or cable.

2. The profile monitoring system of claim 1, wherein the sensing device includes a spring element and a sensor element.

3. The profile monitoring system of claim 2, wherein the spring element is coupled to the tensioning device, and wherein the spring element is configured to be tensioned based on the tension in the wire or cable.

4. The profile monitoring system of claim 2, wherein the sensor element includes a proximity sensor.

5. The profile monitoring system of claim 1 further comprising an output module coupled to the triggering module.

6. A profile monitoring system for a railroad car, the profile monitoring system comprising:

a frame assembly having a first frame member and a second frame member, wherein a space is defined between the first and second frame members to allow the railroad car to pass through;

a first fixture element and a second fixture element coupled to the first and second frame members respectively, each of the first and second fixture elements positioned at a predetermined location;

a wire or cable connected between the first and second fixture elements;

a tensioning device associated with at least one of the first or second fixture elements, the tensioning device configured to be coupled to one end of the wire or cable, wherein the tensioning device is configured to maintain a predetermined tension in the wire or cable;

a sensing device coupled to the tensioning device, the sensing device configured to sense a change in a tension in the wire or cable; and a triggering module communicably coupled to the sensing device, the triggering module configured to trigger an alarm based on the change in the tension in the wire or cable.

7. The profile monitoring system of claim 6, wherein the tensioning device includes a turnbuckle.

8. The profile monitoring system of claim 6, wherein the sensing device includes a spring element and a sensor element.

9. The profile monitoring system of claim 8, wherein the spring element is coupled to the tensioning device, and wherein the spring element is configured to be tensioned based on the tension in the wire or cable.

10. The profile monitoring system of claim 8, wherein the sensor element includes a proximity sensor.

11. The profile monitoring system of claim 6 further comprising an output module coupled to the triggering module.

* * * * *